US005123153A

United States Patent [19]

Krauss

[11] Patent Number: 5,123,153

[45] Date of Patent: Jun. 23, 1992

[54] SLIDING BAR BUCKLE WITH OPPOSING TEETH

[75] Inventor: Mark J. Krauss, East Greenwich, R.I.

[73] Assignee: American Cord & Webbing Co., Inc., Woonsocket, R.I.

[21] Appl. No.: 726,905

[22] Filed: Jul. 8, 1991

[51] Int. Cl.[5] ..... A44B 11/25

[52] U.S. Cl. ..... 24/196; 24/171; 24/194

[58] Field of Search ..... 24/196, 197, 194, 171, 24/181, 68 CD

[56] References Cited

U.S. PATENT DOCUMENTS

| | | | |
|---|---|---|---|
| 1,300,040 | 4/1919 | Stuart | 24/194 |
| 1,836,923 | 12/1931 | Hodge | 24/196 |
| 2,088,820 | 8/1937 | Tompkins | 24/194 |
| 2,754,560 | 7/1956 | Warner et al. | 24/196 |
| 4,608,735 | 9/1986 | Kasai | 24/196 |
| 4,903,378 | 2/1990 | Kasai | 24/196 |

FOREIGN PATENT DOCUMENTS

| | | | |
|---|---|---|---|
| 0701193 | 12/1953 | United Kingdom | 24/196 |
| 0812962 | 5/1959 | United Kingdom | 24/194 |

*Primary Examiner*—Victor N. Sakran

*Attorney, Agent, or Firm*—Kane, Dalsimer, Sullivan, Kurucz, Levy, Eisele and Richard

[57] ABSTRACT

A sliding bar buckle is provided with a grip base with an inwardly facing toothed surface. A strap retainer moves within transverse slots on legs formed integrally with said grip base so that a complementary toothed surface on the strap retainer engages the inwardly facing toothed surface so as to engage a variable position strap therebetween. Connecting bars are additionally formed between said arms to engage a fixed position strap.

4 Claims, 1 Drawing Sheet

FIG. 1
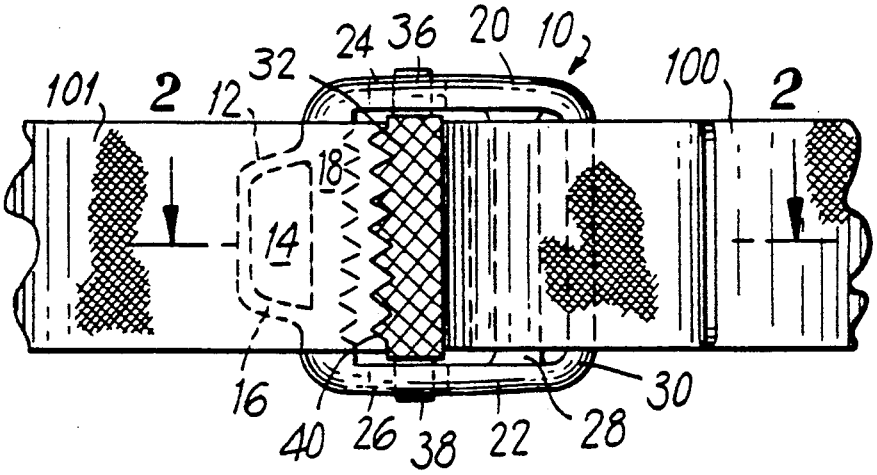
FIG. 2
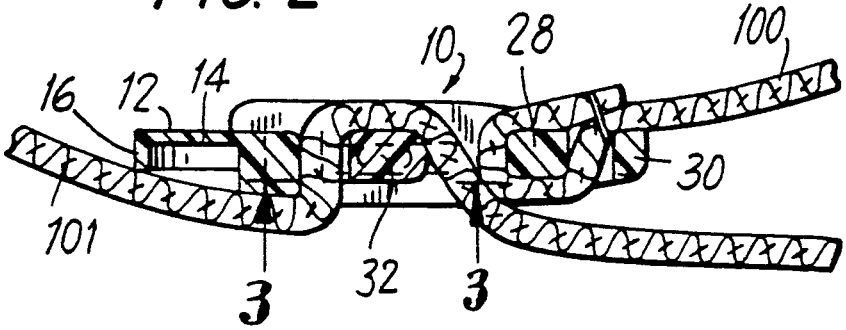
FIG. 3
FIG. 4
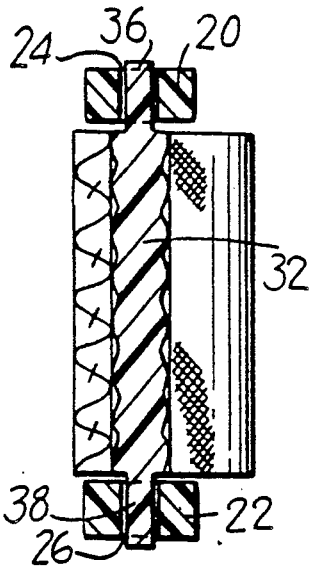
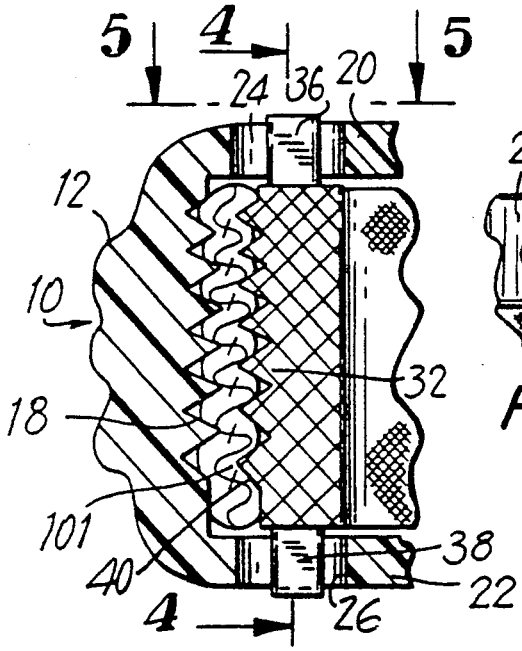
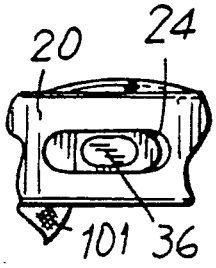
FIG. 5

SLIDING BAR BUCKLE WITH OPPOSING TEETH

BACKGROUND OF THE INVENTION

1. Field of the Invention

This invention relates to a sliding bar buckle with opposing locking teeth on the sliding bar and on the bearing surface.

2. Description of the Prior Art

In the prior art, sliding bar buckles are well-known. Examples of these buckles may be found in U.S. Pat. Nos. 4,608,735 and 4,903,378. However, these sliding bar buckles are deficient in that they do not adequately grip the straps under many circumstances.

OBJECTS AND SUMMARY OF THE INVENTION

It is therefore a primary object of this invention to provide a sliding bar buckle with increased gripping capabilities.

It is therefore a further object of this invention to provide a sliding bar buckle with opposing locking teeth on the sliding bar and on the bearing surface.

The sliding bar buckle of the present invention includes a molded frame with a fixed grip base. The fixed grip base is integral with an inwardly facing toothed bearing surface. The sliding bar buckle further includes a pair of spaced legs extending integrally from opposite ends of the grip base and has a pair of transversely aligned slots which engage a sliding bar with a toothed surface complementary to the toothed bearing surface. The sliding bar bears upon the bearing surface so that the respective toothed surfaces are able to adjustably hold a strap or similar apparatus therebetween.

The sliding bar buckle of the present invention further includes a pair of connecting bars formed between the spaced legs at an opposite end from the grip base. The pair of connecting bars is used to secure a fixed position strap to the sliding bar buckle.

BRIEF DESCRIPTION OF THE DRAWINGS

Further objects and advantages of the invention will become apparent from the following description and claims, and from the accompanying drawings, wherein:

FIG. 1 is a front plan view, partially in phantom, of the sliding bar buckle of the present invention engaging a fixed position strap and a variable position strap.

FIG. 2 is a cross-sectional view along plane 2—2 of FIG. 1 of the sliding bar buckle of the present invention.

FIG. 3 a cross-sectional view along plane 3—3 of FIG. 2 of the sliding bar buckle of the present invention showing the toothed surface of the sliding bar bearing upon the complementary toothed surface of the bearing surface holding a variable position strap therebetween.

FIG. 4 is a cross-sectional view along plane 4—4 of FIG. 3 showing the sliding bar of the sliding bar buckle of the present invention.

FIG. 5 is a cross-sectional view along plane 5—5 of FIG. 4 showing the sliding bar engaging the transverse slots of the spaced legs of the present invention.

DETAILED DESCRIPTION OF THE PREFERRED EMBODIMENT

Referring now to the drawings in detail wherein like numerals indicate like elements throughout the several views, one is able to see that FIG. 1 is a front plan view of the sliding bar buckle 10 of the present invention engaging fixed position strap 100 and variable position strap 101.

Buckle 10 includes grip base 12 having a convex shape. Grip base 12 includes planar gripping surface 14 with ledge 16 (see FIG. 2) around a periphery thereof to allow the user to grip buckle 10 firmly. On an inward surface of grip base 12 is fixed toothed surface 18.

Spaced legs 20, 22 are formed integrally from opposite sides of grip base 12. As shown in FIGS. 1, 3 and 4, legs 20, 22 include transverse slots 24, 26, respectively. Additionally, connecting bars 28, 30 are formed between spaced legs 20, 22 an opposite end from grip base 12. As shown in FIG. 2, fixed position strap 100 passes behind connecting bar 30 and wraps around connecting bar 28 and is fastened to itself. Those skilled in the art will realize that other similar configurations are possible.

Strap retainer or sliding bar 32 includes an enlarged central portion 34 and laterally extending arms 36, 38 which loosely engage transverse slots 24, 26, respectively. Enlarged central portion 34 includes toothed surface 40 which is complementary to toothed surface 18 of grip base 12. As strap retainer 32 moves within transverse slots 24, 26 (see FIG. 5), toothed surface 40 can movably engage toothed surface !8 so as to grip variable position strap 101 between toothed surfaces 18 and 40.

To use buckle 10 (which is typically provided to the consumer with fixed position strap 100 secured around connecting bar 28 as shown on FIG. 2), the user moves strap retainer 32 101 between toothed surface 18 and toothed surface 40. The user then positions strap retainer 32 tightly against grip base 12 so that toothed surfaces 18 and 40 tightly grip variable position strap 101.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A sliding bar buckle comprising:

a grip base having a flat gripping surface with a convex outline outwardly extending from said grip base and a protruding ledge means around said surface, and an inwardly facing toothed bearing surface to grip a variably positioned strap therebetween;

a pair of spaced legs extending integrally from opposite ends of said grip base and having a pair of oppositely aligned slots, said slots having an oblong shape; and a strap retainer including a central enlarged strap engagement portion with a toothed bearing surface complementary to and slidably engaging said inwardly facing toothed bearing surface; and a pair of arms extending integrally from opposite ends of said central strap engagement portion and loosely fitted in said slots, respectively.

2. The sliding bar buckle of claim 1 further including at least one connecting bar formed integrally between said pair of spaced legs opposite from said grip base.

3. The sliding bar buckle of claim 1 further including at least two connecting bars formed integrally between said pair of spaced legs opposite from said grip base, said at least two connecting bars being adapted to engage a fixed position strap.

4. The sliding bar buckle of claim 3 wherein said grip base includes a planar portion with a ledge assembly around a periphery of said planar portion.

* * * * *